United States Patent [19]

Bycroft et al.

[11] Patent Number: 4,950,417

[45] Date of Patent: Aug. 21, 1990

[54] **DETERGENT FORMULATIONS CONTAINING ALKALINE LIPASE DERIVED FROM *PSEUDOMONAS PLANTARII***

[75] Inventors: Nancy L. Bycroft, Constantine, Mich.; Graham S. Byng, Elkhart, Ind.

[73] Assignee: Miles Inc., Elkhart, Ind.

[21] Appl. No.: 346,000

[22] Filed: May 1, 1989

[51] Int. Cl.[5] ..... C11D 3/386; D06M 16/00

[52] U.S. Cl. ..... 252/174.12; 252/DIG. 12; 435/264; 435/874

[58] Field of Search ..... 252/174.12, DIG. 12

[56] References Cited

U.S. PATENT DOCUMENTS 4,707,291 11/1987 Thom et al. ..... 252/174.12

FOREIGN PATENT DOCUMENTS 0271153 6/1988 European Pat. Off. .

OTHER PUBLICATIONS

*Int. Journal of Systematic Bacteriology,* 4/87, pp. 144–152.

*Primary Examiner*—Paul Lieberman
*Assistant Examiner*—A. Beadles-Hay
*Attorney, Agent, or Firm*—Jerome L. Jeffers

[57] ABSTRACT

Disclosed is a detergent formulation containing a non-ionic and/or anionic detergent and the microbial lipase from a bacterium of the species *Pseudomonas plantarii.*

9 Claims, No Drawings

DETERGENT FORMULATIONS CONTAINING ALKALINE LIPASE DERIVED FROM *PSEUDOMONAS PLANTARII*

BACKGROUND OF THE INVENTION

In U.S. Pat. No. 4,707,291 there is disclosed a detergent composition comprising a mixture of an anionic and a nonionic detergent-active compound in combination with a lipase which shows a positive immunological cross-reaction with the antibody of the lipase produced by *Pseudomonas fluorescens* IAM 1057, specifically those produced by a microorganism of the species *Pseudomonas fluorescens* , *P. gladioli* or *Chromobacter viscosum*. While these organisms were known to have lipolytic activity at the time the application which matured into the 4,707,291 patent was filed patentability predicated on the stability of these enzymes in the detergent containing formulation.

In European published application 0 271 153 there is disclosed a composition comprising a nonionic detergent, a protease and a lipase which shows a positive immunological response to the antibody of the lipase produced by *Chromobacter viscosum*, var. *lipolyticum* NRRL-B 3673. Lipases derived from *Pseudomonas* species *P. fluorescens, P. fragi, P. nitroreduscens* var. *lipolyticum, P. cepacia and P. gladioli* are specifically disclosed.

The bacterial genus *Pseudomonas* is actually comprised of four sub-genera. *P. cepacia* and *P. gladioli* belong to *Pseudomonas* subgroup I whereas *P. fragi* and probably *P. nitroreduscens* belong to subgroup I.

Azegami et al report a new species of *Pseudomonas, P. plantarii*, in *Int. Journal of Systematic Bacteriology*, Apr. 1987, p. 144–152. This article indicates a positive response for lipase, using the Tween 80 hydrolysis method, for lipase from the species *P. plantarii* as well as that from *P. gladioli*. All other strains of *P. plantarii* are reported by Azegami to behave identically in the taxonomic tests described, suggesting that this is a very tight homologous species. In addition, the lipase in all 21 tested strains are reported to catalyze both Tween 80 hydrolysis and cottonseed oil hydrolysis. The strain used in these examples, i.e. ATCC 43733, is the Type strain, a designation that means it is the most indicative representative of the new species. While the *gladioli* and *plantarii* species of *Pseudomonas* are related, they have definite taxonomic differences, such as, for example, *P. plantarii* can (whereas *P. gladioli* cannot) utilize L. Rhamose for growth, *P. plantarii* cannot (whereas *P. gladioli* can) utilize trehalose, adonitol, β-alanine, lactose, benzoate, levulinate for growth. *P. plantarii* cannot grow at 40° C. whereas *P. gladioli* can. Furthermore *P. plantarii* has been reported to be pathogenic to rice seedlings whereas *P. gladioli* has not.

SUMMARY OF THE INVENTION

The present invention is a composition comprising a nonionic and/or anionic detergent and bacterial lipase derived from an organism of the species *Pseudomonas plantarii*.

DESCRIPTION OF THE INVENTION

The present invention is predicated on the discovery that lipase from *P. plantarii* is unexpectedly stable in the presence of nonionic and/or anonic detergents. It is significantly more stable than lipase from *P. gladioli* which the prior art recognizes as being detergent stable.

A typical formulation suitable for removing fatty soils from fabrics will include one or more detergent surfactants such as nonionic surfactants [e.g. alkyl and nonylphenylpoly (ethylene glycerol) ethers]; anionic surfactants (e.g. alkylbenzene sulfonates, fatty alcohol ether sulfates or alphaolefin sulfonates) and the powdered lipase typically in an amount of from about 0.1 to 100 lipase units per milligram. Optional ingredients include a detergent builder such as potassium diphosphate, sodium tripolyphosphate, sodium citrate, sodium nitrilotriacetate or sodium silicate; foam boosters (e.g. fatty acid alkanolamides); alkalies (e.g. sodium carbonate); optical brighteners (e.g. stilbene derivatives); stabilizers (e.g. triethanolamine); fabric softeners (e.g. quaternary ammonium salts) together with bleaching agents and systems (such as sodium perborate and ethylene diaminetetraacetate). Additional ingredients may include fragrances, dyes, lather boosters, foam depressors and anticorrosion agents, formulation acids. In addition, other enzymes such as proteases, amylases or cellulases may be present.

A colony of *Pseudomonas plantarii* or *Pseudomonas gladioli* from a nutrient agar plat was used to inoculate 50 ml of the described seed medium. The seed flask was allowed to grow for 24 hours after which time it was diluted 1:1 with a sterile 20% glycerol solution, aliquoted 1.0 ml into 1.5 ml freezer vials and stored at −70° C. for future use. Seed cultures of *P. gladioli*, ATCC 10248, and *P. plantarii*, ATCC 43733, were propagated by inoculating 50 ml of PY80 medium described below with 0.1 ml of a −70° C. frozen stock culture.

| Seed: Medium PY80 | | |
|---|---|---|
| Ingredient | % | gm or ml/flask |
| Peptone | 1.0 | — |
| Yeast extract | 0.1 | — |
| Tween 80 | 1.0 | 5 ml* |
| Distilled $H_2O$ | | 50 ml (final volume) |

*10% stock solution was prepared by autoclaving at 121° C. for 20 minutes, and was added aseptically to each tri-baffled de long necked 300 ml Klett flask after cooling to room temperature.

The inoculated PY80 seed medium was incubated at 28° C. for 16 hours using a New Brunswick G-25-R shaker set at 250 rpm.

The fermentation medium (FGH 80) used is described below:

| Medium FGH80 | | |
|---|---|---|
| Ingredient | % | gm or ml/flask |
| Fish hydrolysate "G" Sopropeche | 1.5 | — |
| Soy bean meal | 1.0 | 0.4 gm |
| K phosphate pH 7.0 | 3 mM | 0.12 ml$^{\Delta}$ |
| Tween 80 | 1.0 | 4 ml* |
| Soft $H_2O$ | | 40 ml (final volume) |

$^{\Delta}$A 1 M, pH 7.0 potassium phosphate stock solution was filtered, sterilized using a 0.2 micron Nalgene filter unit or by autoclaving 15 minutes at 121° C. The sterile stock was then added aseptically to each extra-deep tri-baffled 250 ml shaker flask covered with 3 milk filter pads.

*A 10% Tween 80 stock solution is made, autoclaved 20 minutes, 121° C., cooled and added aseptically to each extra-deep tri-baffled 250 ml flask.

Each fermentation flask was inoculated with 1 ml seed grown as described for seed preparation. The inoculated flasks were incubated at 28° C. for 72 hours with stirring at 425 rpm in a New Brunswick G-25-R shaker.

Alternatively lipase was produced using 30-liter fermentation vessels (Biostat U-300, Braun Instruments, Bethlehem, Pa.). The seed medium used was as described previously with the exception that a volume of 600 ml was grown in fernbach flasks; 600 ml of 16 hour seed culture was transferred into each 30-liter fermentor. The fermentation was stopped after 72 hours incubation at 28° C. with agitation at 300 rpm and aeration at 15 liters/minute with back pressure maintained at 90 Bar.

The lipase powder was obtained by initially heating the fermentor whole beer to 60° C. for 10 minutes. After cooling to 25–30° C., five percent w/v bentonite was added to the heat treated beer. While mixing, an equal volume of isopropanol was added to the bentonite treated beer. The isopropanol/bentonite beer had 0.75% FW-6, a filter aid, added and was then filtered through shark-skin paper using a table filter. The isopropanol filtrate was collected and the isopropanol removed using a vacuum concentrator. The isopropanol-free sample was polished by adding 1% w/v FW-6 filter aid and filtering through a fine bed of the same filter aid. The polished sample was then concentrated by ultrafiltration, using an Amicon PM-10 cartridge, to approximately 8–10X.

Complete precipitation of the proteins was accomplished by the addition of isopropanol to 80% w/v with slow mixing. Proteins were separated from the alcohol by adding 0.5% w/v FW-6 filter aid on a table filter. The dry filter cake was resuspended in water that had been previously adjusted to pH 9.3–9.5 with 1N NaOH at a ratio of water to cake of 1:2. The cake and water were mixed for 20 minutes and then refiltered. The slurry process was repeated two additional times with all of the filtrates being saved and frozen at −70° C. overnight. The frozen filtrate was then lyophilized to obtain a powdered lipase preparation.

Detergent formulations containing powdered lipase prepared as described above were formulated and tested for stability. These experiments are described in the following examples:

EXAMPLE I

The stability of lipase from *P. plantarii* and *P. gladioli* in a wash system was determined by adding 3,000 Esterase units of lipase per liter of standard tap water along with 1.96 ml detergent base WA.

| WA Detergent (Liquid) Base | |
|---|---|
| Ingredients | Parts by Weight |
| Stepam Bio Soft D-62 (anionic surfactant) | 28.0 |
| Neodol 25-7 (nonionic surfactant) | 7.0 |
| Sodium Xylene Sulfonate | 12.0 |
| Triethanolamine (TEA) | 2.0 |
| Sodium Citrate | 12.0 |
| Water | qs to 100 parts |

The mixture was incubated at 45° C. and then assayed at 0, 10, 20, 30, 40, 50 and 60 minutes by titrating the production of butyrate produced in gum arabic emulsions of tributyrin at pH 8.5 and 45° C. to determine percent of enzyme activity remaining. A blank containing the detergent and water was also assayed. The detergent did not interfere with the assay.

| Results % Activity Remaining | | |
|---|---|---|
| Time | *P. plantarii* lipase | *P. gladioli* lipase |
| 0 | 100 | 100 |
| 10 | 100 | 100 |
| 20 | 100 | 87 |
| 30 | 100 | 40.8 |
| 40 | 98.8 | 20.1 |
| 50 | 90.9 | 7.9 |
| 60 | 77.9 | 4.9 |

From the foregoing data, it can be determined that lipase from *P. plantarii* is inherently more stable to simulated detergent wash conditions that contain mixtures of anionic and nonionic surfactants.

EXAMPLE II

The relative stability of *P. plantarii* and *P. gladioli* lipase were also tested in a wash system containing 1 g/liter ALL ® laundry detergent powder containing a nonionic detergent formulation from Lever Brothers, Inc. Each lipase, 3,000 esterase units per liter, were added to the ALL wash system at 45° C. and assayed at 0, 10, 20 and 40 minutes by titrating the production of butryate produced in gum arabic emulsions of tributyrin at pH 8.5 and 45° C. to determine percent of enzyme activity remaining. A blank containing the detergent and water was also assayed. The detergent did not interfere with the assay.

| Results % Activity Remaining | | |
|---|---|---|
| Time | *P. plantarii* lipase | *P. gladioli* lipase |
| 0 | 100 | 100 |
| 10 | 100 | 100 |
| 20 | 100 | 89.2 |
| 30 | 100 | 59.9 |
| 40 | 100 | 24.7 |

Improved stability of *P. plantarii* lipase compared to *P. gladioli* lipase, which has similar pH and temperature optimums, was observed under the specified conditions. This property would be advantageous in pre-soak applications or spot cleansing prior to washing, in addition to incorporation in standard detergent formulations for enhanced removal of fatty stains during the regular wash cycle.

We claim:

1. A cleaning formulation comprising a detergent selected from the group consisting of anionics, nonionics and mixtures thereof and a lipase derived from a bacterium of the species *Pseudomonas plantarii* wherein said lipase is present in an amount of from 0.1 to 100 lipase units per milligram of the formulation.

2. The formulation of claim 1 wherein there is included a nonionic detergent selected from the group consisting of alkyl and nonylphenylpoly (ethylene glycerol) ethers.

3. The formulation of claim 1 which contains an anionic detergent which is an alkylbenzene sulfonate, a fatty alcohol ether sulfate or an alpha olefin sulfonate.

4. The formulation of claim 1 wherein the lipase is in powdered form and is present in an amount of from 0.1 to 100 lipase units per milligram of formulation.

5. The formulation of claim 1 wherein there is also included a detergent builder.

6. The formulation of claim 5 wherein the detergent builder is potassium diphosphate, sodium tripolyphosphate, sodium citrate, sodium nitrilotriacetate or sodium silicate.

7. The formulation of claim 6 wherein the *P. plantarii* has the identifying characteristics of ATCC 43733.

8. A fabric cleaning composition which comprises a detergent selected from the group consisting of anionics, nonionics and mixtures thereof and a detergent builder along with from 0.1 to 100 lipase units per milligram of the composition of a powdered lipase derived from a bacterium of the species *Pseudomonas plantarii*.

9. The composition of claim 8 wherein the *P. plantarii* has the identifying characteristics of ATCC 43733.

* * * * *

UNITED STATES PATENT AND TRADEMARK OFFICE

CERTIFICATE OF CORRECTION

PATENT NO. : 4,950,417

DATED : August 21, 1990

INVENTOR(S) : Bycroft et al.

It is certified that error appears in the above-identified patent and that said Letters Patent is hereby corrected as shown below:

Column 1, line 31, please change "subgroup I" to --subgroup II--.

Signed and Sealed this

First Day of October, 1991

*Attest:*

*Attesting Officer*

HARRY F. MANBECK, JR.

*Commissioner of Patents and Trademarks*